US010619971B2

(12) United States Patent
Hubbell et al.

(10) Patent No.: US 10,619,971 B2
(45) Date of Patent: Apr. 14, 2020 f
(54) HANDGUARD ATTACHMENT SYSTEM FOR A FIREARM

(71) Applicant: Sig Sauer, Inc., Newington, NH (US)

(72) Inventors: Reed Hubbell, Newmarket, NH (US); Harry Andrew Packard, Amesbury, MA (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 16/138,388

(22) Filed: Sep. 21, 2018

(65) Prior Publication Data

US 2019/0101355 A1 Apr. 4, 2019

Related U.S. Application Data

(60) Provisional application No. 62/561,705, filed on Sep. 22, 2017.

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01)

(58) Field of Classification Search
CPC ..... F41A 21/482; F41A 21/48; F41A 5/18; F41C 23/16; F41G 11/003
USPC ..... 42/71.01, 75.01–75.02, 75.1
See application file for complete search history.

(56) References Cited

U.S. PATENT DOCUMENTS 2,685,754 A * 8/1954 Crittendon ..... F41C 7/02 42/16
5,412,895 A * 5/1995 Krieger ..... F41A 21/482 42/75.02
6,499,245 B1 * 12/2002 Swan ..... F41C 23/00 42/124
6,671,990 B1 * 1/2004 Booth ..... F41C 23/16 42/75.01
RE39,465 E * 1/2007 Swan ..... 42/124
7,458,179 B2 * 12/2008 Swan ..... F41G 11/003 42/105
7,716,865 B2 * 5/2010 Daniel ..... F41C 23/16 42/75.01
7,770,317 B1 * 8/2010 Tankersley ..... F41C 23/16 42/71.01
8,141,285 B2 * 3/2012 Brown ..... F41A 3/66 42/71.01
8,141,289 B2 * 3/2012 Gomez ..... F41C 23/16 42/90
8,251,051 B2 * 8/2012 Maggiore ..... A01M 3/00 124/40
8,276,303 B2 * 10/2012 Kapusta ..... F41C 23/16 42/71.01

(Continued)

*Primary Examiner* — Michael D David
(74) *Attorney, Agent, or Firm* — Finch & Maloney PLLC

(57) ABSTRACT

A handguard assembly system for a firearm is disclosed. The system includes a handguard with an elongate perforated structure extending between a first end and a second end, where the handguard defines a handguard connector on the first end. An interfacing connector attaches to the handguard connector when the handguard is installed on the firearm. When installed on the firearm, the handguard extends over the barrel without directly contacting the barrel, and attaches to the firearm via the interfacing connector and an upper receiver connector on the firearm upper receiver.

10 Claims, 19 Drawing Sheets

(56) References Cited

U.S. PATENT DOCUMENTS 8,448,367 B2 * 5/2013 Samson ..... F41A 13/12 42/75.02
8,453,364 B2 * 6/2013 Kucynko ..... F41C 23/16 42/71.01
8,782,943 B2 * 7/2014 Jarboe ..... F41A 21/485 42/75.02
8,904,691 B1 12/2014 Kincel
9,140,506 B2 * 9/2015 Gomez ..... F41A 21/487
9,322,609 B2 * 4/2016 Davies ..... F41A 3/94
9,389,043 B1 7/2016 Zhang
D764,620 S * 8/2016 Packard ..... D22/103
9,423,194 B2 * 8/2016 Fritz ..... F41A 3/66
9,476,672 B2 * 10/2016 Wells ..... F41C 23/16
D815,710 S * 4/2018 Packard ..... D22/103
9,995,557 B2 6/2018 Geissele
10,126,095 B1 11/2018 Reid
10,145,648 B1 12/2018 Holder et al.
10,295,304 B1 5/2019 Kincel et al.
10,309,747 B2 6/2019 Samson et al.
10,401,122 B2 9/2019 Williams
2003/0230022 A1 * 12/2003 Battaglia ..... F41G 11/003 42/111
2004/0049964 A1 * 3/2004 Vais ..... F41A 21/482 42/75.02
2006/0065112 A1 * 3/2006 Kuczynko ..... F41A 5/28 89/193
2007/0017139 A1 * 1/2007 Larue ..... F41A 21/482 42/75.1
2010/0095575 A1 * 4/2010 Swan ..... F41C 23/16 42/72
2011/0126443 A1 6/2011 Sirois
2011/0192066 A1 8/2011 Kimmel et al.
2011/0247254 A1 * 10/2011 Barnes ..... F41A 21/48 42/71.01
2012/0324775 A1 * 12/2012 Troy ..... F41C 23/16 42/71.01
2013/0180151 A1 * 7/2013 Moore ..... F41C 27/00 42/90
2014/0075817 A1 * 3/2014 Gomez ..... F41A 21/48 42/75.02
2016/0025120 A1 1/2016 Swan et al.
2016/0054096 A1 * 2/2016 Dzwill ..... F41A 21/48 42/75.02
2016/0169617 A1 6/2016 Daley, Jr.
2016/0195350 A1 * 7/2016 Packard ..... F41A 9/55 42/6
2017/0097207 A1 4/2017 Hines
2019/0226799 A1 * 7/2019 Hubbell ..... F41G 11/003

* cited by examiner

HANDGUARD ATTACHMENT SYSTEM FOR A FIREARM

RELATED APPLICATIONS

This application claims priority under 35 U.S.C. § 119(e) to U.S. Provisional Patent Application No. 62/561,705 titled HANDGUARD ATTACHMENT SYSTEM FOR A FIREARM, and filed on Sep. 22, 2017, the contents of which are incorporated herein by reference in its entirety.

FIELD OF THE DISCLOSURE

This disclosure relates generally to firearms, and more particularly, to a handguard including an interfacing connector to a firearm.

BACKGROUND

A handguard is a device attached to a firearm for gripping the weapon and for protecting the hands of the user from the barrel, which may become very hot when firing. The handguard is typically configured for attaching accessories by including M-LOK or KeyMod holes, a Picatinny rail (also known as a MIL-STD-1913 accessory rail, STANAG 2324 rail, tactical rail, or M1913), or a combination thereof. Handguards can be made from a variety of materials, including metals, such as steel (carbon and stainless), aluminum alloys, titanium, or magnesium, and polymeric materials, such as polymers reinforced with carbon or glass.

SUMMARY

The present disclosure relates to a handguard assembly for a firearm, systems for attaching a handguard to a firearm, and methods for attaching a handguard to a firearm upper receiver. In one embodiment, a handguard attachment system includes a firearm upper receiver having a distal end portion with an upper receiver connector. A handguard is removably attachable to the firearm upper receiver and extends from a first end to a second end with a handguard connector on the first end. The handguard connector is configured to engage the upper receiver connector when installed on the firearm upper receiver. An interfacing connector is constructed and arranged to attach to the handguard connector and secure the handguard connector to the firearm upper receiver.

In some embodiments, the firearm comprises a barrel with a gas block and a tube or rod extending from the gas block to the firearm upper receiver. The handguard is configured to extend over the barrel and the gas block without directly contacting the barrel when installed on the firearm upper receiver.

In some embodiments, the upper receiver connector comprises a barrel nut connector. In some such embodiments, the handguard connector engages an outside surface of the barrel nut connector when the handguard is installed on the firearm upper receiver.

In some embodiments, the upper receiver connector comprises a barrel nut connector and a barrel nut threadably attached to the barrel nut connector, where the handguard connector engages an outside surface of the barrel nut when the handguard is installed on the firearm upper receiver.

In some embodiments, the interfacing connector is installed over the tube or rod and disposed in contact with an upper surface of the barrel nut connector when the handguard is installed on the firearm upper receiver.

In some embodiments, the upper receiver defines an alignment opening and the interfacing connector defines an alignment lug received in the alignment opening when the handguard is installed on the firearm upper receiver.

In some embodiments, the interfacing connector is received in the handguard connector when the handguard is installed on the firearm upper receiver. For example, the handguard connector slides over the interfacing connector during assembly.

In some embodiments, the handguard assembly system includes a barrel nut connected to the barrel nut connector. The interfacing connector includes a protrusion on a bottom surface, that is received in a circumferential slot defined at least in part by the barrel nut. For example, the circumferential slot is defined axially between the barrel nut and the barrel nut connector. In another example, the circumferential slot is defined in an outside surface of the barrel nut.

In some embodiments, the handguard is attached to the firearm upper receiver exclusively via the interfacing connector and the upper receiver connector.

In some embodiments, the handguard is free floating over the barrel when installed on the firearm upper receiver.

In some embodiments, the interfacing connector defines a plurality of threaded apertures and the handguard connector defines a plurality of through apertures. Each of the plurality of through apertures is aligned with a corresponding threaded aperture when the handguard is installed on the firearm upper receiver. In some embodiments, the system includes a plurality of fasteners each configured to extend through one of the through apertures in the handguard connector and engage the corresponding one threaded aperture in the interfacing connector, where each of the fasteners extends inward and upward with respect to a median plane extending through the firearm upper receiver.

In some embodiments, the interfacing connector is located in a slot extending through the firearm upper receiver.

In some embodiments, the interfacing connector is monolithic with the upper receiver.

In other embodiments, a handguard assembly for a firearm includes an upper receiver with a barrel nut connector. A barrel or barrel assembly is secured to the upper receiver by threaded engagement between a barrel nut and the barrel nut connector. An interfacing connector is disposed in contact with a top surface of the barrel nut. A handguard with an elongate perforated structure extends between a first end and a second end. The first end defines a handguard connector, where the handguard connector extends over the barrel nut connector, the barrel nut, and the interfacing connector when the handguard is installed on the upper receiver. Fasteners are configured to be installed between the handguard connector and the interfacing connector when the handguard is installed on the upper receiver. When installed on the firearm, the handguard extends over the barrel without directly contacting the barrel.

In some embodiments, the handguard connector engages the barrel nut connector when the handguard is installed on the firearm.

In some embodiments, the handguard connector engages an outside surface of the barrel nut when the handguard is installed on the firearm. For example, the handguard connector engages the cylindrical body of the barrel nut.

In some embodiments, the handguard assembly includes a gas block attached to the barrel and a tube or rod extending from the gas block to the upper receiver. In some such embodiments, the interfacing connector defines a channel configured to receive therethrough the tube or rod.

In some embodiments, the interfacing connector defines at least one protrusion from a bottom surface. The protrusion(s) is (are) received in a circumferential slot defined at least in part by the barrel nut when the handguard is installed on the firearm.

In some embodiments, the interfacing connector engages an upper portion of the barrel nut and the handguard connector engages a lower portion of the barrel nut when the handguard is installed on the firearm.

In some embodiments, the handguard assembly includes fasteners extending upward from the handguard connector and into the interfacing connector.

In another embodiment, a handguard assembly is constructed for attaching a handguard to a firearm having an upper receiver, a barrel, and a gas block. In one embodiment, the assembly includes a handguard with an elongate perforated structure extending between a first end and a second end, the handguard defining a handguard connector on the first end. An interfacing connector is constructed and arranged to engage the upper receiver and attach to the handguard connector when the handguard is installed on the firearm. When installed on the firearm, the handguard extends over the barrel and the gas block without directly contacting the barrel.

In some embodiments, the handguard connector is configured to engage a barrel nut connector on the upper receiver. In other embodiments, the handguard connector is configured to engage an outside surface of a barrel nut secured to the barrel nut connector.

In some embodiments, the interfacing connector includes a left-side portion and a right-side portion. Each of the left-side portion and the right-side portion defines at least one threaded aperture configured to align with a corresponding aperture in the handguard when the handguard is installed on the upper receiver.

In some embodiments, the interfacing connector is integral to the upper receiver and extends distally of the upper receiver above the barrel.

In some embodiments, the interfacing connector defines a channel configured to receive therethrough a tube extending from the gas block to the upper receiver.

In some embodiments, the handguard assembly also includes an upper receiver with a barrel, a gas block attached to the barrel, and a tube or rod extending between the gas block and the upper receiver. A barrel nut connector is on a distal portion of the upper receiver and configured for threaded engagement with a barrel nut on the barrel. Fasteners are configured to be installed between the handguard connector and the interfacing connector. The interfacing connector extends over a top of the tube extending from the gas block to the upper receiver when the handguard is installed on the firearm.

In some embodiments, the interfacing connector is integral to the upper receiver.

In some embodiments, the barrel nut connector is constructed and arranged to mate with the handguard connector.

In some embodiments, the interfacing connector includes a connector body with an alignment lug extending proximally, and the upper receiver defines an alignment opening corresponding to and constructed to receive the alignment lug. When the handguard is installed on the upper receiver, the alignment lug is received in the alignment opening.

In some embodiments, the interfacing connector is installed over the tube extending between the gas block and the upper receiver with the interfacing connector in contact with the barrel nut connector.

In some embodiments, the interfacing connector is received in the handguard connector when the handguard is installed on the firearm.

In some embodiments, the interfacing connector defines at least one protrusion from a bottom surface, the protrusion is received in a circumferential slot defined at least in part by the barrel nut when the handguard is installed on the firearm.

In some embodiments, the interfacing connector engages an upper portion of the barrel nut connector and the handguard connector engages a lower portion of the barrel nut connector when the handguard is installed on the firearm.

In some embodiments, the upper receiver defines an upper receiver connector comprising the barrel nut connector and the interfacing connector, where the upper receiver connector is integral to the upper receiver, and wherein the handguard connector is configured to engage the upper receiver connector when installed on the firearm.

In some embodiments, the barrel nut connector has female threads configured to engage a barrel nut with male threads In some embodiments, the interfacing connector contacts an upper portion of the barrel nut connector when the handguard is installed on the firearm.

In some embodiments, the upper receiver defines a slot configured to receive the interfacing connector therethrough. When the handguard is installed on the upper receiver, the interfacing connector is disposed in the slot with a left-side portion extending from a left side of the slot and a right-side portion extending from a right side of the slot. Each of the left-side portion and the right-side portion defines at least one threaded aperture configured to engage one of the fasteners and align with a corresponding aperture in the handguard connector. Tightening the fasteners into the interfacing connector draws the handguard against the barrel nut connector.

Another aspect of the present disclosure is directed to a method of attaching a handguard to a firearm, the method comprising providing a firearm upper receiver comprising an upper receiver connector that includes a barrel nut connector and a barrel nut, a barrel with a gas block, and a tube or rod extending from the gas block to the firearm upper receiver; providing a handguard extending from a first end to a second end and defining a handguard connector on the first end; disposing an interfacing connector in contact with the upper receiver connector, the interfacing connector configured to attach to the handguard; sliding the handguard over the barrel and the gas block and onto the upper receiver connector in alignment with the interfacing connector; installing fasteners through the handguard connector and into the interfacing connector; and tightening the fasteners to draw the handguard connector against the upper receiver connector, thereby securing the handguard to the firearm without direct contact with the barrel or the gas block.

In some embodiments, disposing the interfacing connector on the firearm upper receiver includes placing the interfacing connector over the tube or rod and in engagement with the upper receiver connector.

In some embodiments, disposing the interfacing connector on the firearm upper receiver includes placing the interfacing connector in contact with a top surface of the barrel nut.

In some embodiments, sliding the handguard over the barrel and the gas block and onto the upper receiver connector includes the handguard connector sliding along an outside surface of the barrel nut.

In some embodiments, sliding the handguard over the barrel and the gas block and onto the upper receiver connector includes sliding the handguard connector over the interfacing connector.

In some embodiments, providing the firearm upper receiver includes selecting the upper receiver connector to be integral to the firearm upper receiver and comprising a barrel nut connector.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

Figure 1A:
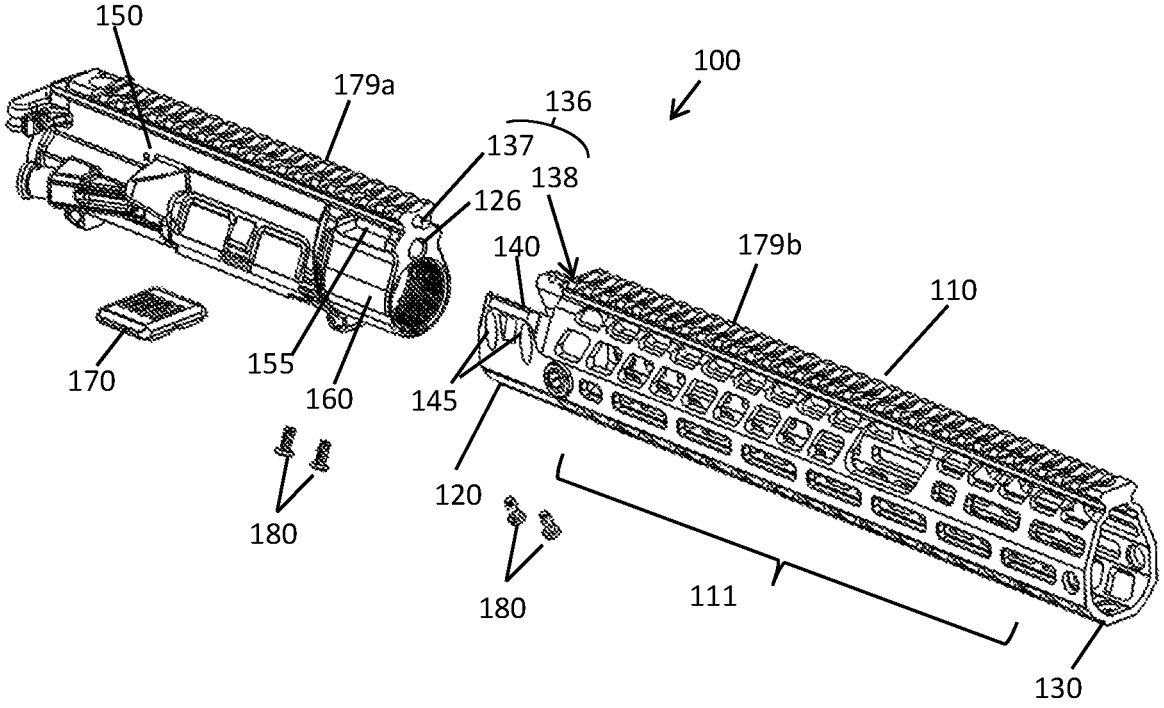
FIG. 1A illustrates a top, right-side, and front perspective view of an example handguard assembly system for a firearm, in accordance with an embodiment of the present disclosure.

The figures depict various embodiments of the present disclosure for purposes of illustration only. Numerous variations, configurations, and other embodiments will be apparent from the following detailed description.

DETAILED DESCRIPTION

The present disclosure is directed to a handguard attachment system for a firearm. Existing handguard systems are attached to the firearm using fasteners that are positioned above the barrel nut of the firearm and extend horizontally through the rifle perpendicular to the bore. The barrel nut is threaded onto the upper receiver to mount the barrel and to provide a mounting surface for the handguard. In these types of systems, the barrel nut typically includes a groove around the outside diameter, forward or distally of the threaded portion of the barrel nut. Fasteners extend to engage the groove to secure the handguard system to the firearm. The fasteners are threaded through complementary holes in the handguard, in some instances with accompanying hardware. In these prior-art handguards, the position of the fasteners can interfere with the placement and operation of some components of rifles, such as the gas tube or operational rod of semiautomatic rifles and the like. Other types of handguard systems use fasteners positioned below the barrel nut of the firearm to pinch together a slot in the handguard to thereby clamp the handguard to the barrel nut. These fasteners can interfere with a user's grip and increase discomfort for the user when gripping the rear of the handguard. These systems also lack cosmetic appeal. Additionally, the clamping action of the handguard around the barrel nut can become ineffective after multiple installations of the handguard, due to stretch or fatigue of the metal of the handguard, which is typically aluminum.

Thus, a need exists for improvements to handguard attachment systems for rifles, such as semiautomatic and automatic rifles. In accordance with a set of embodiments of the present disclosure, a free-floating handguard can be attached to a firearm upper receiver without interference with or direct contact with the barrel or gas system. In accordance with a set of embodiments, a handguard for attachment to a firearm engages an interfacing connector constructed and arranged to be attached to a complementary upper receiver connector on a firearm upper receiver. In some embodiments, the upper receiver connector is the barrel nut connector or barrel nut on the distal end of the upper receiver. In other embodiments, the upper receiver connector is a component installed over the barrel nut and/or barrel nut connector. In some embodiments, the upper receiver connector includes a barrel nut constructed and arranged such that the interfacing connector contacts the barrel nut and is received by the handguard connector when the handguard is installed on the upper receiver.

Embodiments of the handguard can be attached to the firearm by fastening to the interfacing connector and engaging the upper receiver connector, where the interfacing connector is disposed along an upper or top portion of the barrel and the handguard connector engages the upper receiver connector below the barrel. Accordingly, the handguard is free floating and need not be supported by any other portion of the firearm, such as the gas block or barrel. Numerous configurations and variations will be apparent in light of the present disclosure. Other suitable uses and implementations of one or more embodiments of the present disclosure will depend on a given application or intended use and will be apparent in light of this disclosure. As will be apparent from the present disclosure, embodiments described herein may be implemented with various firearms, including, for example, semiautomatic and automatic rifles with a direct impingement system or gas-piston system, bolt-action rifles, rifles with blowback operation, and other firearms. Embodiments of the handguard attachment system may also be used with short-barreled rifles, semiautomatic shotguns, submachine guns, and pistols based on the AR-15 or similar platforms. Not all components of such firearms are illustrated. Embodiments of the present disclosure may be modified depending on whether the intended use is military, law enforcement, sport, competition, or other use. The structure and further details of various embodiments of the handguard assembly system will be described with respect to the following drawings.

As discussed herein, the barrel can be part of a barrel assembly that also includes a barrel extension and clocking pin, in accordance with some embodiments. Accordingly, descriptions of securing a barrel to the upper receiver may inherently include components of the barrel assembly, as will be appreciated. As also discussed herein, terms referencing direction, such as upward, downward, vertical, horizontal, left, right, front, back, etc., are used for convenience to describe embodiments of a handguard attachment system for a firearm, where the firearm is oriented with the barrel extending horizontally and grip extending down from the lower receiver. Embodiments of the present disclosure are not limited by these directional references and it is contemplated that systems and methods in accordance with the present disclosure can be used in any orientation.

FIG. 1A is a right-side and front perspective view of an example handguard assembly system 100, in accordance with an embodiment of the present disclosure. For clarity, FIG. 1A does not show not all components of the firearm 101, which is illustrated in FIG. 1F. The handguard assembly system 100 includes a handguard 110 that, in one aspect, includes an elongate perforated structure 111 extending between a first end 120 and a second end 130. The elongate perforated structure 111 can include, for example, M-LOK or KeyMod holes, a rail 179, such as a Picatinny rail (also known as a MIL-STD-1913 accessory rail, STANAG 2324 rail, tactical rail, or M1913 rail), or a combination thereof, although neither is required for the handguard 110 to function in connection with the present disclosure. In one aspect, the handguard 110 further includes a handguard connector 140 on the first end 120. A portion of the handguard assembly system 100 is integral to a firearm upper receiver 150. In one embodiment, the firearm upper receiver 150 includes a complementary upper receiver connector 160 constructed and arranged to be coupled, mated, or attached to the handguard connector 140. The handguard 110 can be made from any suitable structural material, including, without limitation, steel (carbon and stainless), aluminum, titanium, or magnesium. An example firearm may be, for example, an AR15, M16, M4, SIG516, or SIG716 rifle. Other suitable firearms will be apparent in light of the present disclosure.

Figure 1B:
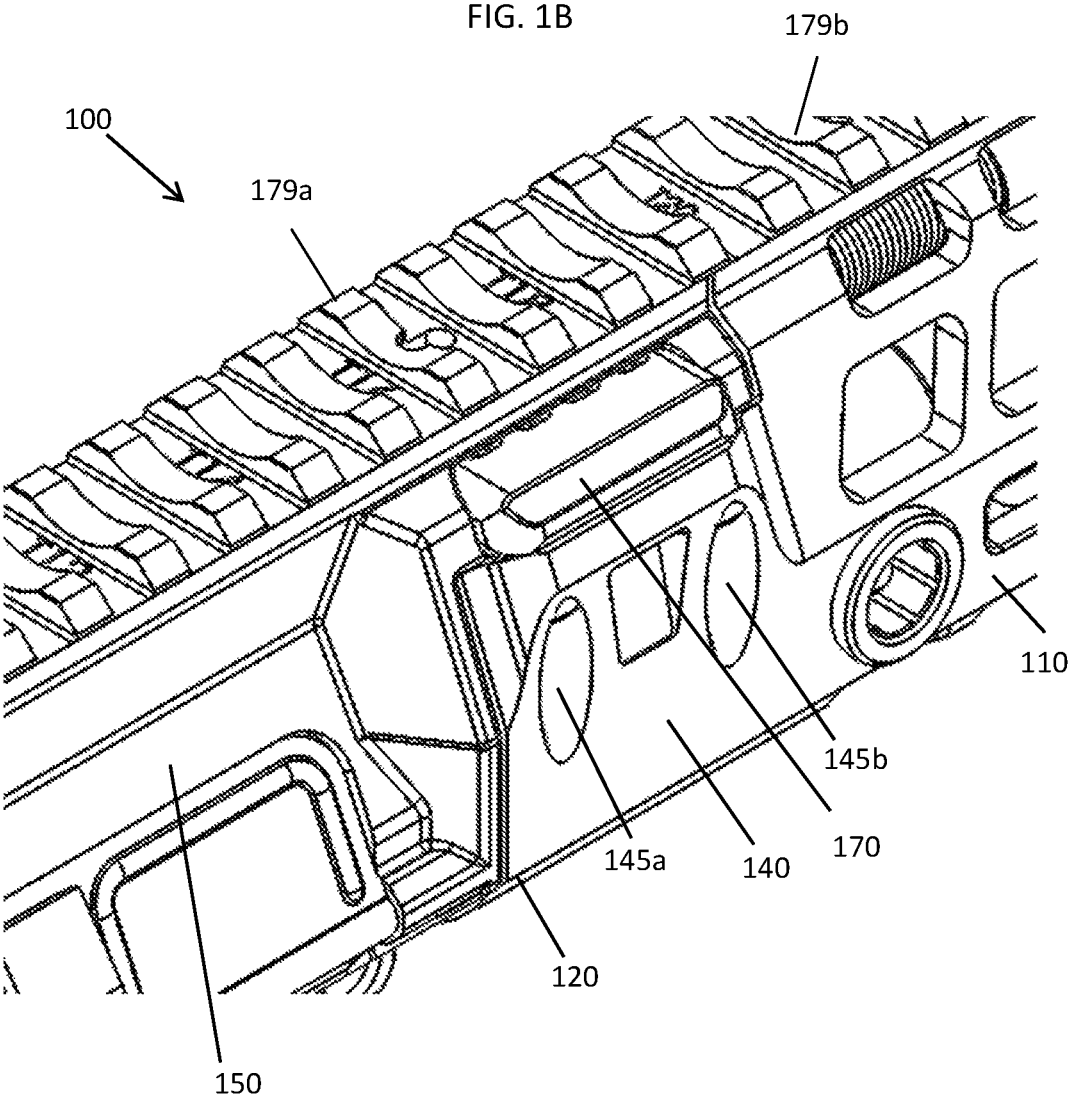
FIG. 1B illustrates a right-side, top, and rear perspective view of part of the example handguard assembly system for a firearm, in accordance with an embodiment of the present disclosure.

As shown in FIGS. 1A and 1B, the handguard assembly system 100 further includes an interfacing connector 170 configured to be attached to the handguard connector 140 on the handguard 110. The interfacing connector 170 is designed as a bridge connector or interfacing insert connecting the handguard 110 to the firearm upper receiver 150. As such, the interfacing connector 170 is also constructed and arranged to be attached to the complementary upper receiver connector 160 (shown in FIG. 1A) on the firearm upper receiver 150. The interfacing connector 170 can be a unitary body made of any suitable shape to accommodate different diameter handguards as well as different upper receivers. In one aspect, the interfacing connector 170 is located in a slot 155 in the firearm upper receiver 150. For example, slot 155 extends laterally through, or is defined in an upper surface of, the firearm upper receiver 150. As shown in FIG. 1A, slot 155 extends laterally through upper receiver 150 beneath a proximal rail portion 179*a*. FIG. In one embodiment, the interfacing connector 170 is a separate component that can be removably installed in the slot 155; FIG. 1B shows the interfacing connector 170 disposed in and extending through the slot 155. As will be apparent from this disclosure, locating the interfacing connector 170 in the slot 155 enables rapid detachment and replacement of the interfacing connector 170. As further described below, the interfacing connector 170 is constructed and arranged to connect the handguard connector 140 to the upper receiver connector 160 to couple the handguard 110 to the firearm upper receiver 150. The interfacing connector 170 can be made from any suitable structural material, including, without limitation, steel (carbon and stainless), aluminum, titanium, or magnesium. In one aspect, the interfacing connector 170 is a metal-injection-molded (MIM) part made of, for example, steel. If made of a metal other than steel, then interfacing connector 170 can include steel inserts for the threaded apertures described below. An example of acceptable inserts is the Heli-Coil® inserts as sold by Stanley Engineered Fastening of Cleveland, Ohio.

In some embodiments, the handguard assembly system 100 includes an alignment structure 136 between the upper receiver 150 and the handguard 110 or interfacing connector 170. The alignment structure 136 is useful, for example, to precisely align handguard 110 with upper receiver 150. Alignment structure 136 is also useful to align proximal rail portion 179*a* with distal rail portion 179*b* so that rail 179 has the same structure (within acceptable tolerances) as a single, continuous rail 179 extending along the upper receiver 150 and handguard 110. For example, the alignment structure 136 provides consistent rotational, axial, lateral, and/or vertical alignment between handguard 110 to upper receiver 150.

Figure 1C:
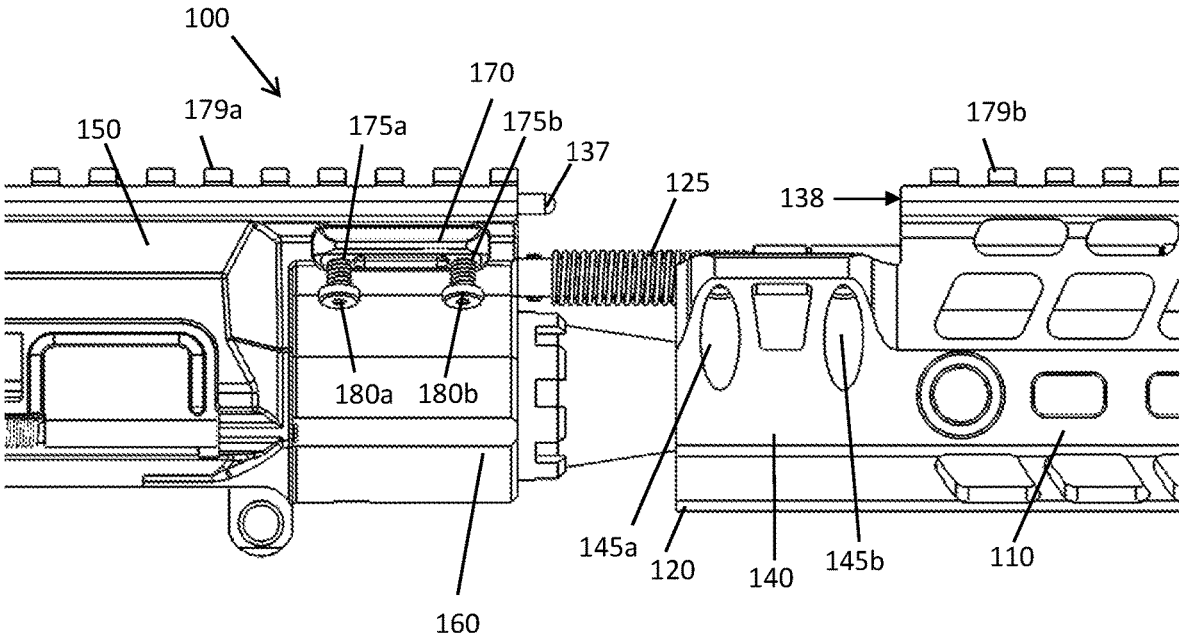
FIG. 1C illustrates a right-side elevational view of part of the example handguard assembly system for a firearm, in accordance with an embodiment of the present disclosure.

In one embodiment, alignment structure 136 is the combination of a lug 137 and a corresponding recess or opening 138, where the lug 137 can be received in the opening 138. As shown in FIGS. 1A and 1C, for example, alignment structure 136 includes a lug 137 extending axially from upper receiver 150. Lug 137 can be received in a corresponding opening 138 in handguard 110, or vice versa. In one example, lug 137 extends from upper receiver connector 160 between a top of proximal rail portion 179 and op rod opening 126. Lug 137 is received in a bore or like opening 138 in handguard 110 below a top of distal rail portion 179*b*. When assembled, such as shown in FIG. 1B, handguard 110 is aligned with upper receiver 150 with proximal rail portion 179*a* aligned with distal rail portion 179*b*. Note that lug 137 can have various cross-sectional shapes and sizes, including circular, rectangular, a T-shape, or other shape, as will be appreciated. Additionally, some embodiments of lug 137 have an inconsistent geometry along its length. Numerous variations will be apparent in light of the present disclosure.

Figure 1D:
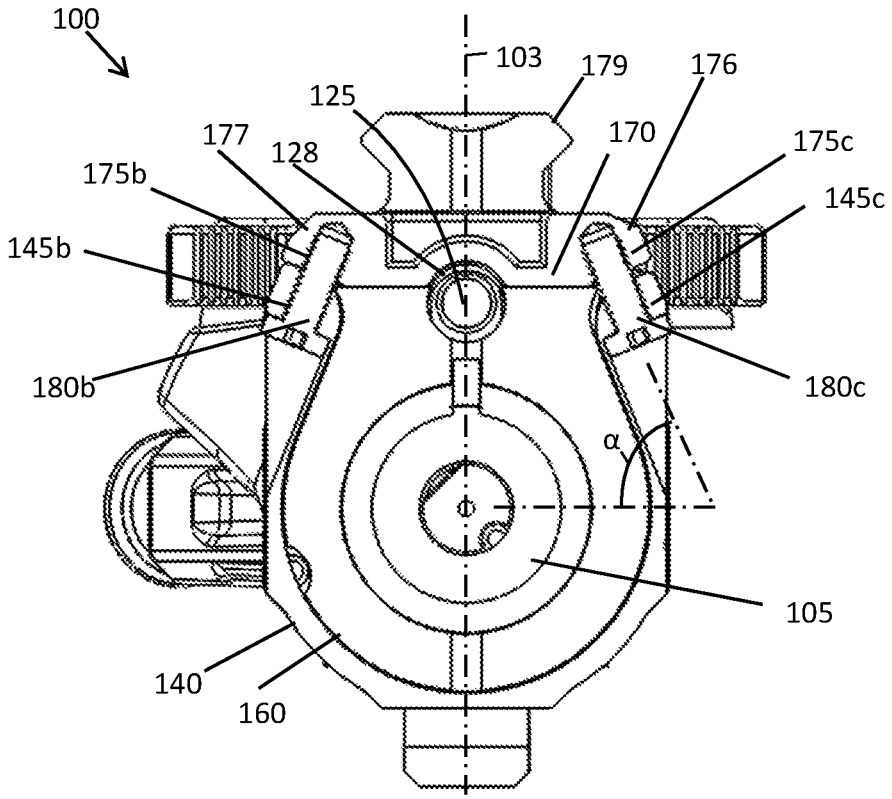
FIG. 1D illustrates a cross-sectional view taken through the handguard connector and as viewed looking into the barrel of the firearm, in accordance with an embodiment of the present disclosure.

As shown in FIGS. 1C, and 1D, the handguard connector 140 includes a plurality of apertures 145. In embodiments, the handguard connector 140 has two, four, or other number of apertures 145 each configured to receive a fastener 180 therethrough. In one embodiment, the interfacing connector 170 includes a plurality of threaded apertures 175 each corresponding to one of the plurality of apertures 145 in the handguard connector 140. In embodiments, the firearm handguard assembly system 100 further includes a plurality of fasteners 180, each of which is configured to extend through one of the apertures 145 of the handguard connector 140 and engage a respective aperture 175 in the interfacing connector 170. Fasteners 180 can be a machine screw, bolt, clamp, lever, turnbuckle, catch, turn-lock fastener, or other suitable fastener, as will be appreciated. For example, each fastener 180 is a threaded machine screw or the like that engages a similarly threaded aperture 175 in the interfacing connector 170. Accordingly, fasteners 180 couple the handguard 110 to the firearm upper receiver 150 by threaded engagement or other means.

For purposes of illustrating the assembly, FIG. 1C shows fasteners 180*a* and 180*b* configured to extend through corresponding apertures 145*a*, 145*b* in handguard connector 140, and threadably engage corresponding threaded apertures 175*a* and 175*b* of the interfacing connector 170. For example, after handguard connector 140 and upper receiver 160 are assembled together with apertures 145*a*, 145*b* aligned with threaded apertures 175*a*, 175*b*, respectively, the fasteners 180*a* and 180*b* are threaded into the threaded apertures 175*a* and 175*b* to secure the handguard 110 to the upper receiver 150. In one embodiment, the handguard connector 140 slides onto the upper receiver connector 160 to couple the handguard 110 to the firearm upper receiver 150, followed by installation of fasteners 180.

As shown in FIGS. 1C and 1D, there is typically not enough clearance between the barrel 105 and the op rod 125 for long fasteners to be inserted horizontally therebetween. Further, an op rod 125 cannot be moved or deformed to accommodate fasteners 180 without affecting its operation. One embodiment of interfacing connector 170 defines threaded apertures 175 that extend at an angle inclined to the horizontal, thereby avoiding interference with op rod 125.

As shown in the end view of FIG. 1D, in one aspect, each fastener 180 is angled upward and inward towards a median plane 103 extending vertically through the upper receiver 150. Each fastener 180 extends into the interfacing connector 170, thereby partially deforming and clamping the C-shaped handguard connector 140 around the upper receiver connector 160 to secure the handguard assembly 100 to the firearm. Having the fasteners 180 angled upward and inward can provide better clamping of the handguard connector 140 than horizontal fasteners 180, depending on the geometry of the firearm. In some instances, when viewed along into barrel 105 as shown in FIG. 1D, fasteners 180 can extend at an angle $\alpha$ in a range of between 0° (e.g., shown in FIG. 3B) and 90°, between 20° and 80° (approximately 70° shown in FIG. 1D), or between 40° and 80°, all ranges inclusive of the recited endpoints.

For example, threaded apertures 175*b*, 175*c* extend into the right-side portion 177 and left-side portion 176, respectively, of interfacing connector 170 at an angle $\alpha$ of about 70° to the horizontal or other suitable angle $\alpha$. Interfacing connector 170 also defines part of channel 128 in a bottom surface 129 to provide clearance for the operational rod 125 of the firearm. As shown in the end view of FIG. 1D and bottom perspective view of FIG. 1E, channel 128 in interfacing connector 170 can have a semicircular shape to receive all or part of op rod 125 therethrough. In other embodiments, channel 128 can be an opening axially through interfacing connector 170 and having a circular or other shape suitable to permit movement of op rod 125 therethrough.

Figure 1E:
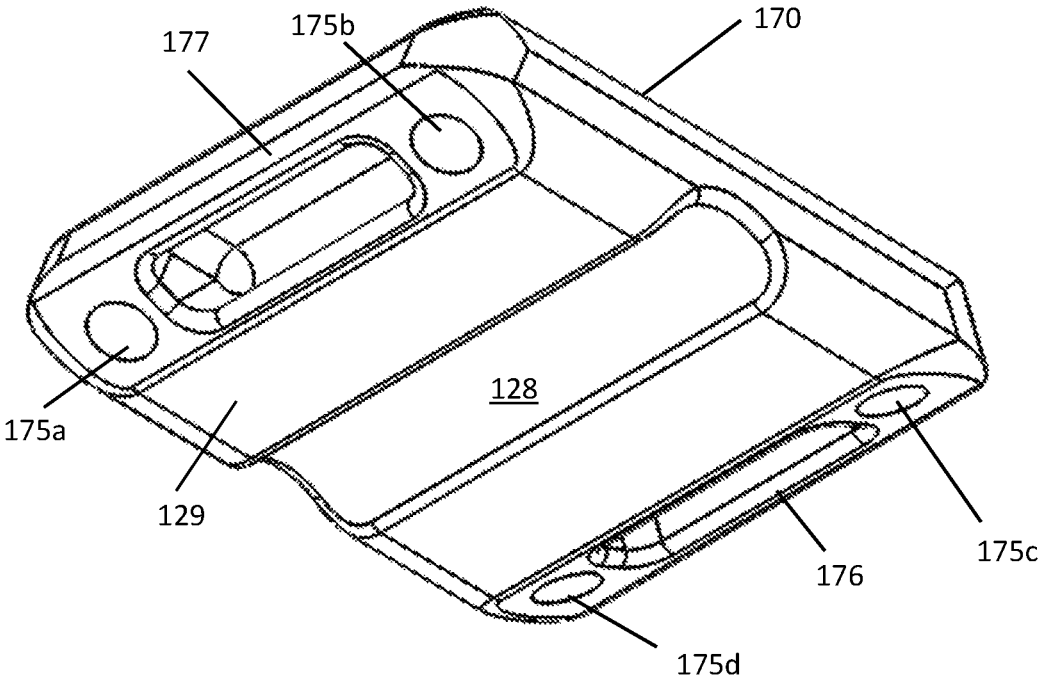
FIG. 1E illustrates a bottom perspective view of an interfacing connector of a handguard assembly system, in accordance with an embodiment of the present disclosure.
Figure 1F:
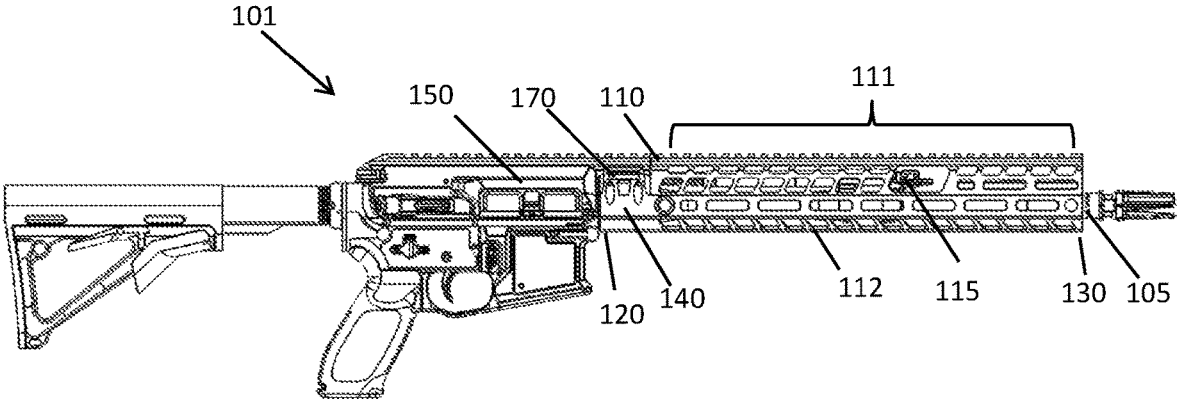
FIG. 1F illustrates a right side elevational view of a handguard assembly system shown installed on a firearm, in accordance with an embodiment of the present disclosure.

FIG. 1E illustrates a bottom perspective view of interfacing connector 170 in accordance with an embodiment of the present disclosure. As shown, interfacing connector 170 generally has a plate-like structure and defines a central recess or channel 128 in bottom surface 129 configured to accept a gas tube or op rod 125 therethrough. In one embodiment, channel 128 is concave. Other geometries are acceptable. Apertures 175*a*, 175*b* extend into a bottom face of right-side portion 177 and apertures 175*c*, 175*d* extend in to a bottom face of left-side portion 177.

FIG. 1F illustrates a side elevational view of a firearm 101 with handguard 110 installed according to an embodiment of the present disclosure. The handguard 110 includes an elongate perforated structure 111 configured to fit over a barrel 105 and a gas block 115 of the firearm 101 in a free-floating fashion without directly contacting the barrel 105 or gas block 115. A beneficial aspect of the handguard 110 is that the entire length of the lower profile 112 of the handguard 110 is devoid of protrusions, enabling improved ergonomics for a user, and compatibility with various rifle attachments, such as, for example, grenade launchers. A beneficial aspect of mounting the handguard 110 directly to the firearm upper receiver 150 of the firearm 101 is that the handguard 110 is free floating with respect to the barrel and can be slid on and off the upper receiver connector 160 of the firearm upper receiver 150 without interference from the gas block 115 or the barrel 105. The gas block 115 actuates an operational rod 125 (also referred to herein as an "op rod") to eject a cartridge casing out of the firearm after firing. The op rod 125 travels in a channel 128 as shown, for example, in FIG. 1E.

Figure 2A:
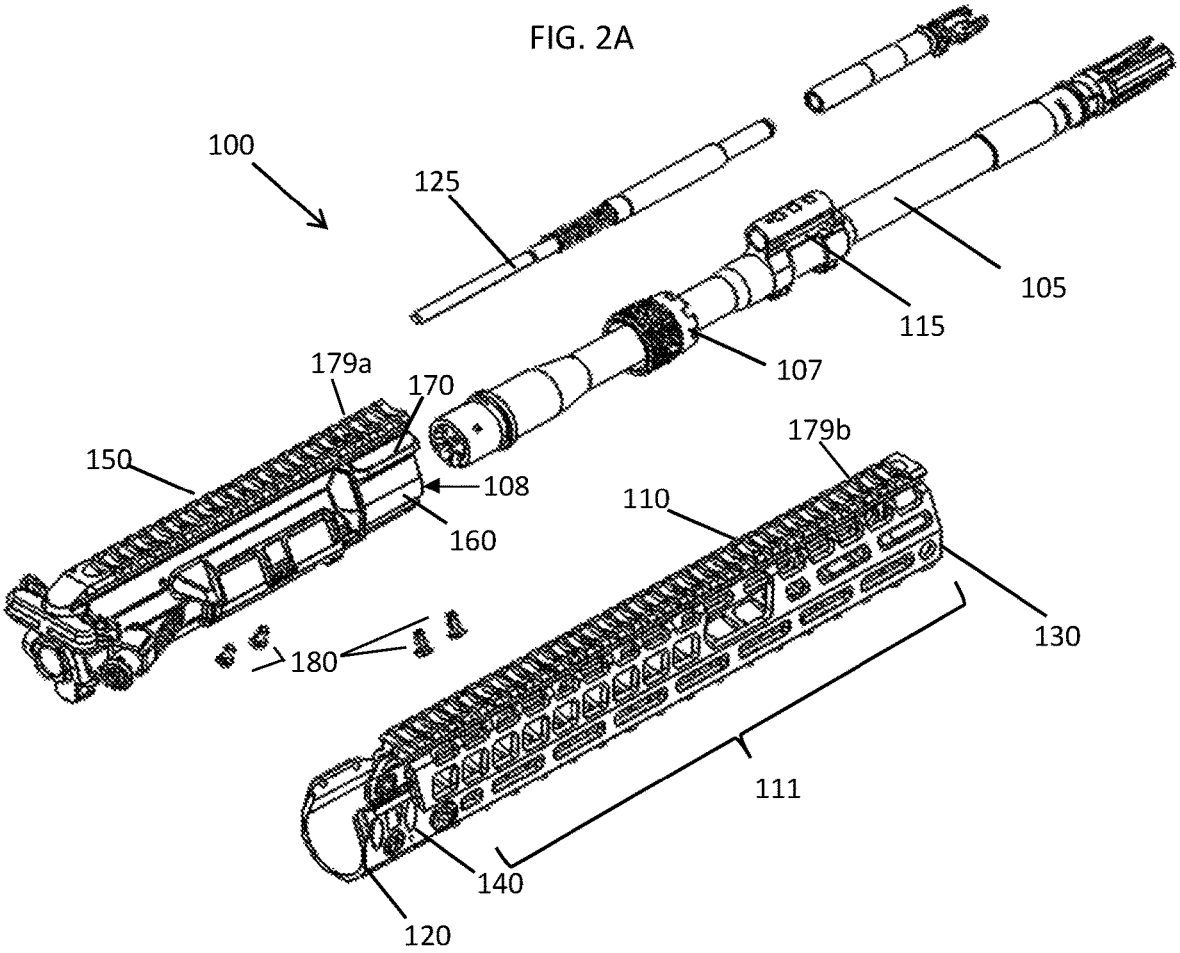
FIG. 2A illustrates an exploded top, right-side, and rear perspective views of a handguard assembly systems for a firearm showing an interfacing connector integral to the upper receiver, in accordance with an embodiment of the present disclosure.
Figure 2B:
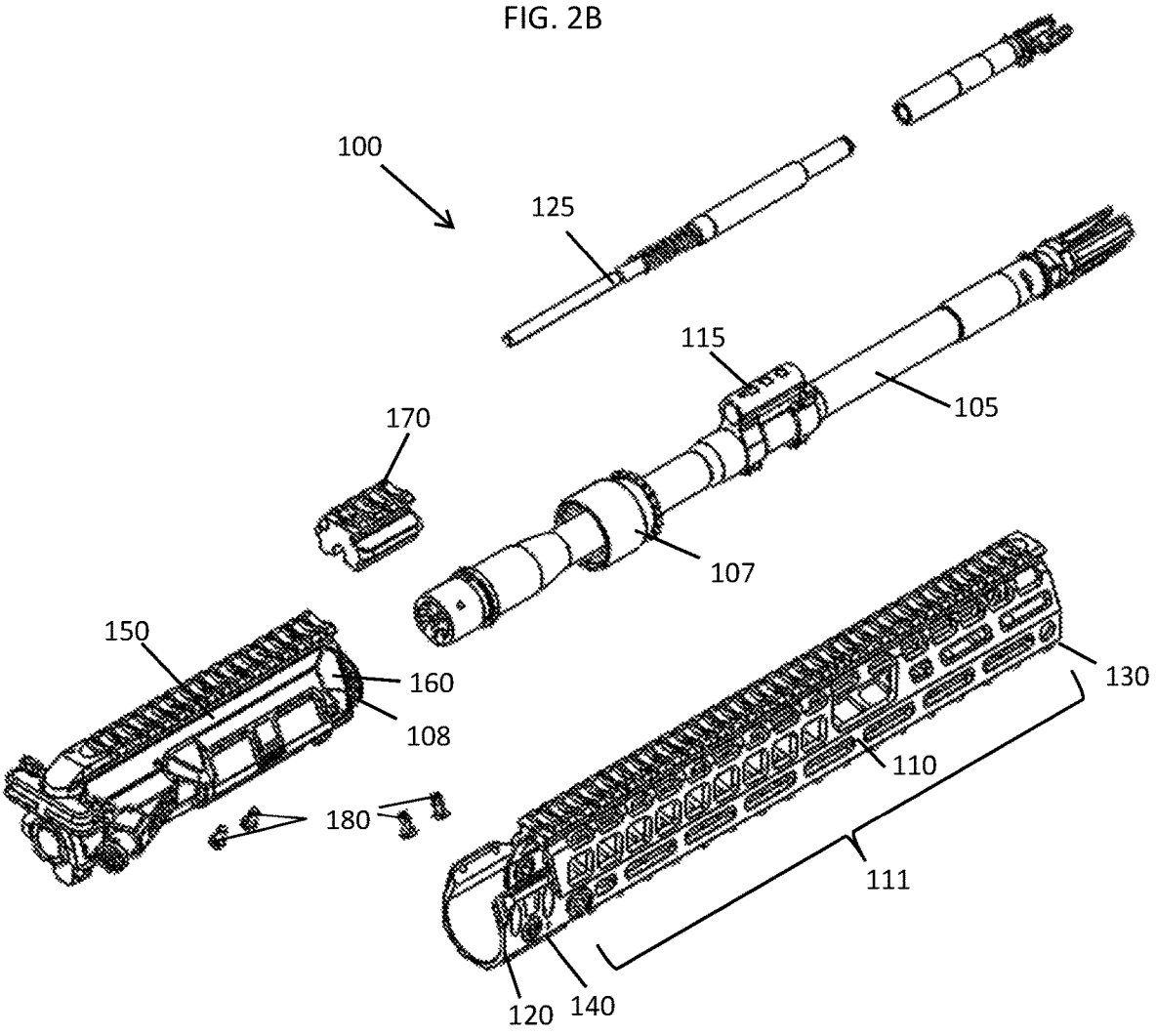
FIG. 2B illustrates an exploded top, right-side, and rear perspective views of a handguard assembly systems for a firearm showing the interfacing connector separate from the upper receiver, in accordance with some embodiments of the present disclosure.
Figure 2C:
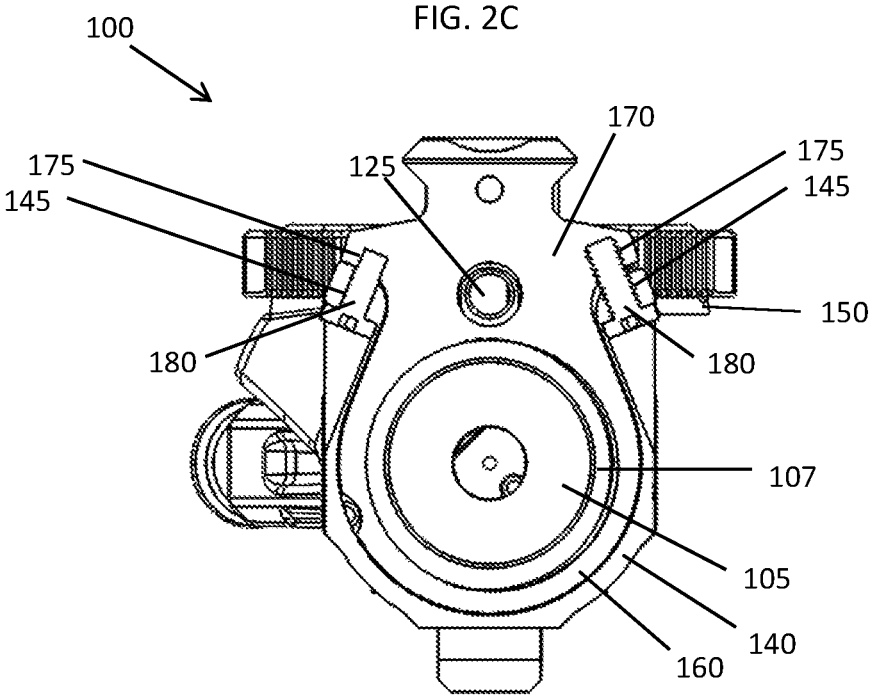
FIG. 2C illustrates a cross-sectional view taken through the handguard connector as viewed looking into the barrel, in accordance with an embodiment of the present disclosure.
Figure 2D:
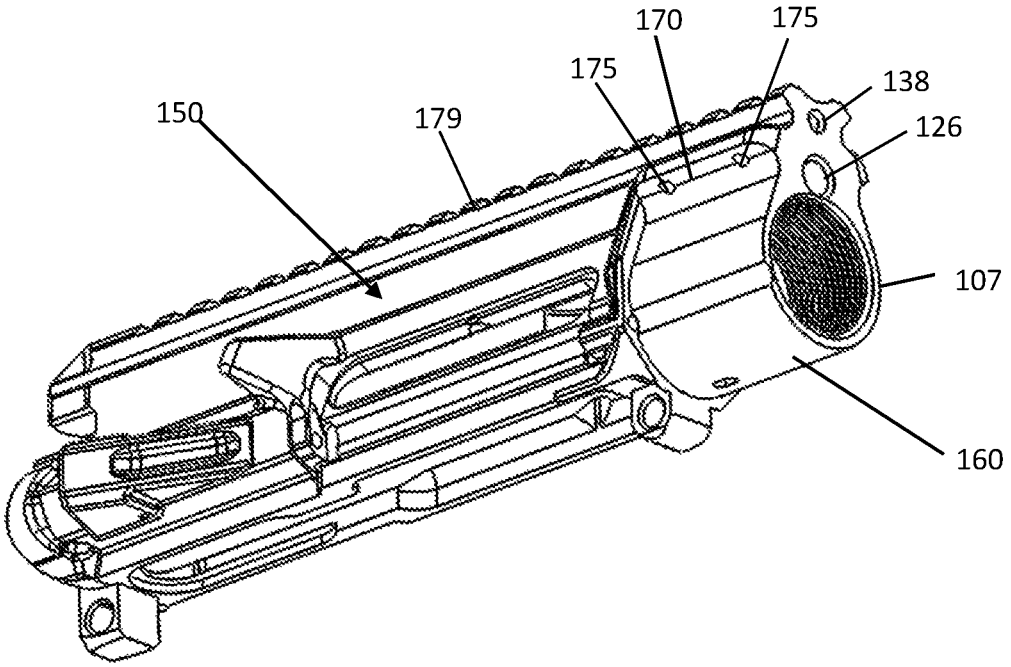
FIG. 2D illustrates a bottom, right-side, and front perspective view of the upper receiver of FIG. 2A showing a barrel nut connector with female threads, in accordance with an embodiment of the present disclosure.
Figure 2E:
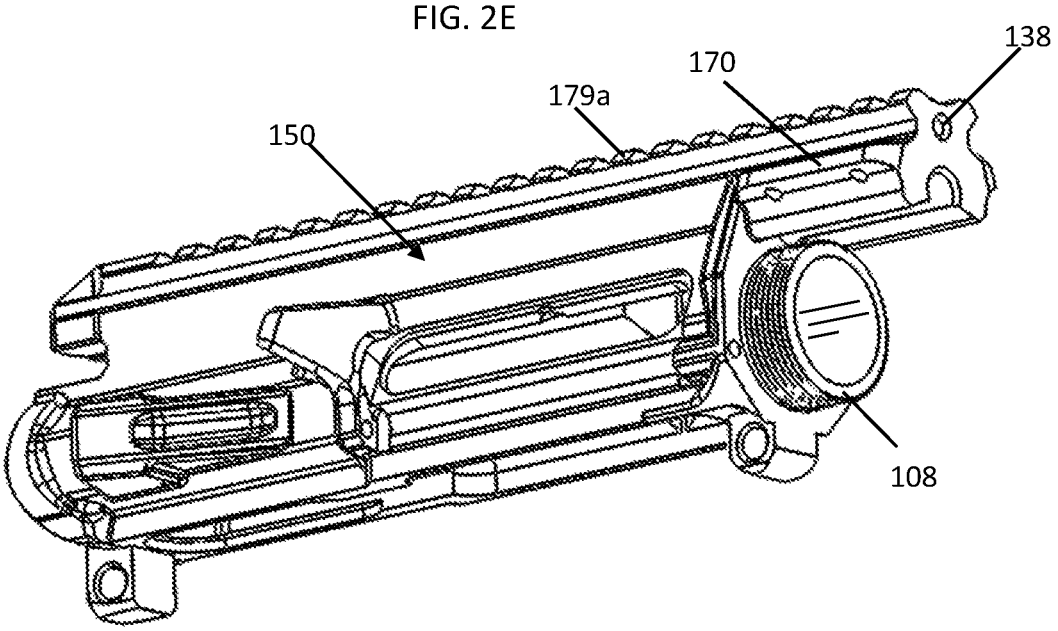
FIG. 2E illustrates a bottom, right-side, and front perspective view of the upper receiver showing a barrel nut connector with male threads, in accordance with an embodiment of the present disclosure.

Turning now to FIGS. 2A-2E another embodiment of handguard assembly system 100 is shown. FIGS. 2A and 2B illustrate top, rear, and right-side perspective exploded views of handguard assembly system 100; FIG. 2C illustrates an end view of handguard assembly system 100; FIGS. 2D and 2E illustrate right-side, bottom, and front perspective views of embodiments of an upper receiver of handguard assembly system 100. As with embodiments discussed above, handguard assembly system 100 includes a handguard 110 extending axially from a first end 120 to a second end 130. The handguard 110 has a handguard connector 140 on the first end 120. In one aspect, the handguard 110 includes an elongate perforated structure 111 that is configured to fit over a barrel 105 and a gas block 115 of a firearm without directly contacting the barrel 105, gas block 115, or op rod 125 (or gas tube). Handguard assembly system 100 also includes a firearm upper receiver 150 that includes a complementary upper receiver connector 160 constructed and arranged to be coupled to the handguard connector 140. In some embodiments, the upper receiver connector 160 is a barrel nut connector 108 or barrel nut 107 threaded into or formed as part of the distal end of the upper receiver 150. In other embodiments, the upper receiver connector 160 is a separate component that is installed between and engages the upper receiver 150 and handguard 110. The handguard assembly system 100 further includes an interfacing connector 170 that is integral to the firearm upper receiver 150. For example, interfacing connector 170 can be molded, cast, forged, or machined as part of the firearm upper receiver 150.

The barrel 105 can be attached to the firearm upper receiver 150 using a threaded barrel nut 107 that engages the barrel nut connector 108 on firearm upper receiver 150. In one embodiment, the barrel nut 107 has external threads to engage the firearm upper receiver 150. As shown in FIG. 2A, for example, barrel nut 107 has male threads corresponding to female threads of barrel nut connector 108 within the upper receiver connector 160. In contrast, FIG. 2B illustrates an example of barrel nut 107 with female threads to engage male threads on barrel nut connector 108 on upper receiver 150.

FIG. 2C is a cross-sectional illustration of the handguard assembly system 100 as viewed looking into the barrel 105. In embodiments, the handguard assembly system 100 further includes a plurality of threaded fasteners 180, each corresponding to an aperture 145 in handguard connector 140 and a threaded aperture 175 in the interfacing connector 170. For example, handguard assembly system 100 includes at least two fasteners 180 that each pass through a respective one of the apertures 145 in the handguard connector 140. Each fastener 180 engages threads in a respective one of the threaded apertures 175 of the integral interfacing connector 170 to couple the upper receiver connector 160 to the firearm upper receiver 150. In some embodiments, handguard assembly system 100 has four fasteners 180 corresponding to four apertures 145 in handguard connector 140 and four threaded apertures 175 in interfacing connector 170.

FIG. 2D illustrates a bottom, right-side, and front perspective view of upper receiver 150 in accordance with another embodiment of the present disclosure. Interfacing connector 170 is integral to the upper receiver 150 and includes upper receiver connector 160 with threaded barrel nut connector 108 with female threads to engage barrel nut 107 (shown in FIG. 2A). Interfacing connector 170 extends laterally from upper receiver 150 just below rail 179. As such, handguard connector 140 can slide over upper receiver connector 160 to align apertures 145 of handguard connector 140 with apertures 175 of interfacing connector 170, followed by installation of fasteners 180 upwardly into interfacing connector 170 to secure the handguard 110 to the upper receiver 150. When installed, handguard connector 140 is held tightly against upper receiver connector 160 by fasteners 180 (shown in FIG. 2C) engaging interfacing connector 170. FIG. 2D also shows an alignment opening 138 extending axially into rail 179 above op rod opening 126. Alignment opening 138 is sized and configured to receive a corresponding alignment protrusion or lug 137 (not shown) extending rearwardly from handguard 110.

FIG. 2E illustrates a bottom, right-side, and front perspective view of upper receiver 150 in accordance with yet another embodiment of the present disclosure. The interfacing connector 170 is integral to the upper receiver 150 and includes proximal rail portion 179*a*. In this embodiment, upper receiver connector 160 includes a male barrel nut connector 108 extending from the distal end of the upper receiver 150. Barrel nut connector 108 is configured to mate with female threads of a sleeve-like barrel nut 107, such as shown in FIG. 2B. The proximal rail portion 179*a* along interfacing connector 170 is configured to align with the distal rail portion 179*b* along handguard 110 so as to permit attachment of optics or other accessories as consistent with a single, continuous rail. Similar to the embodiment of FIG. 2D discussed above, handguard connector 140 can slide over barrel nut 107 attached over the barrel nut connector 108 to align apertures 145 in handguard connector 140 with apertures 175 of interfacing connector 170, followed by installation of fasteners 180 to secure the handguard 110 to the upper receiver 150. When installed, handguard connector 140 is held tightly against the barrel nut 107 by fasteners 180 (shown in FIG. 2C) engaging interfacing connector 170, where the barrel nut 107 serves as the upper receiver connector 160.

Figure 3A:
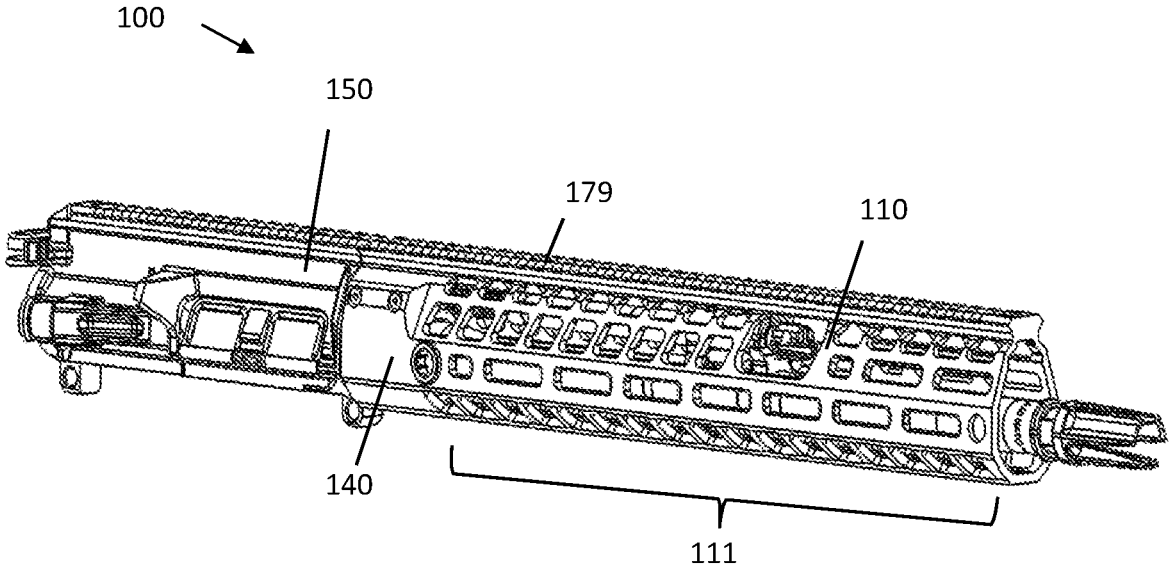
FIG. 3A illustrates a right-side, top, and front perspective view of a handguard assembly system showing the handguard installed on the upper receiver, in accordance with an embodiment of the present disclosure.
Figure 3B:
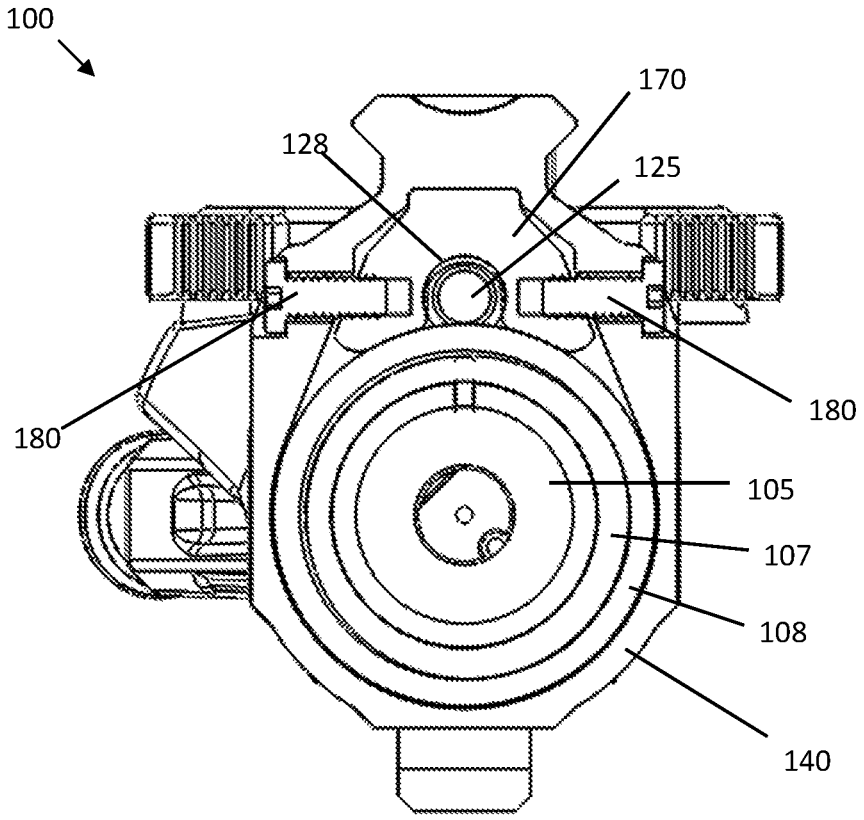
FIG. 3B illustrates a cross-sectional view taken through the handguard connector of a handguard assembly system of FIG. 3A as viewed looking into the barrel of the firearm and showing fasteners extending horizontally, in accordance with an embodiment of the present disclosure.
Figure 3C:
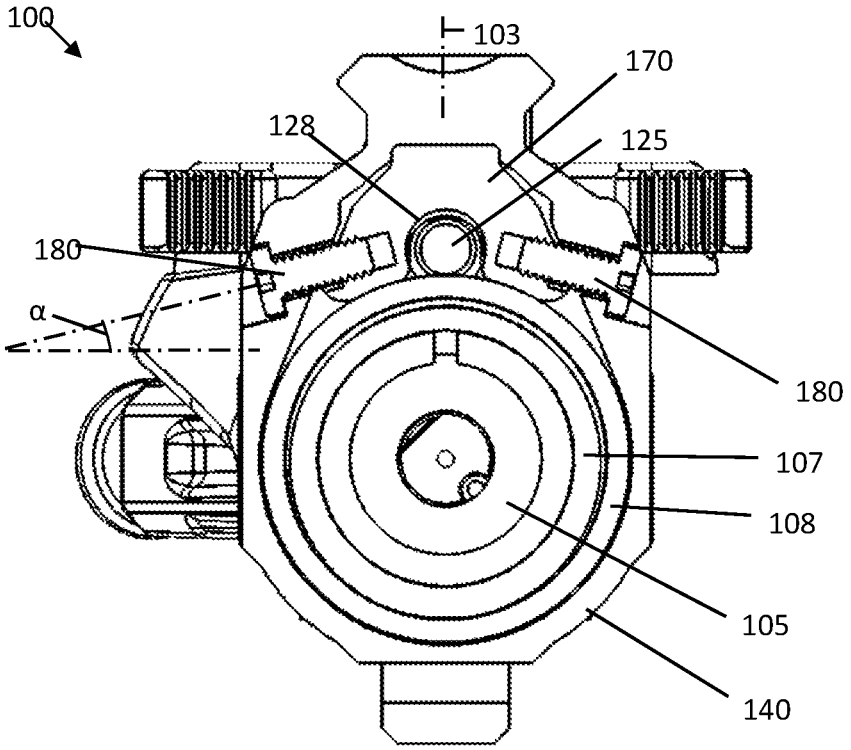
FIG. 3C illustrates a cross-sectional view taken through the handguard connector of a handguard assembly system as viewed looking into the barrel of the firearm and showing fasteners extending upwardly, in accordance with an embodiment of the present disclosure.
Figure 3D:
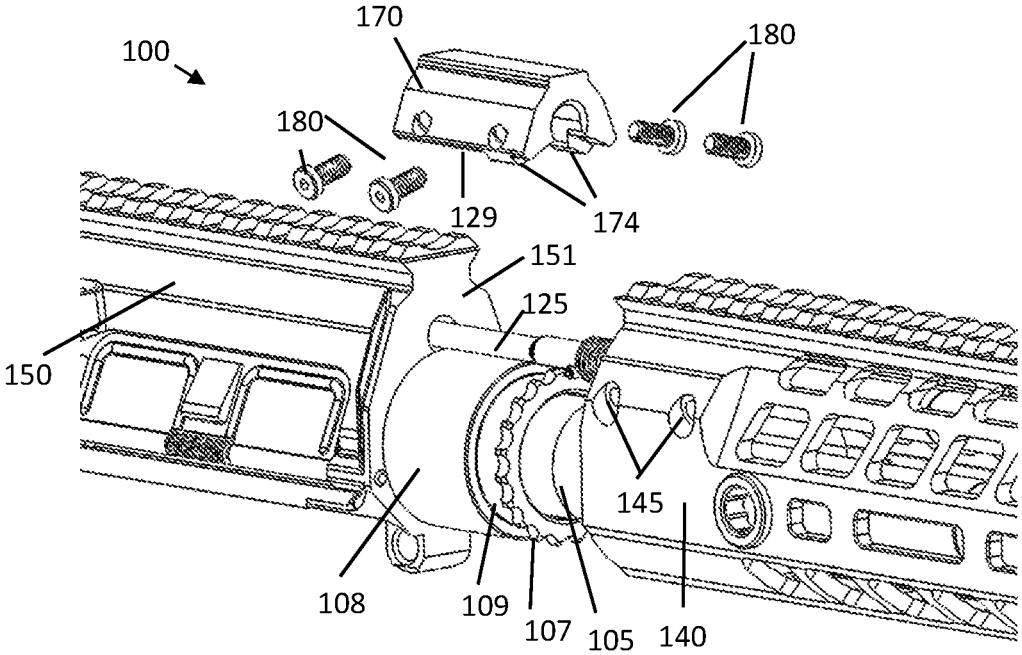
FIG. 3D illustrates a top, right-side, and front perspective view the handguard assembly system of FIG. 3A showing the components partially exploded and the handguard partially installed over the barrel, in accordance with an embodiment of the present disclosure.

Turning now to FIGS. 3A-3D, handguard assembly system 100 is illustrated in accordance with another embodiment of the present disclosure. FIG. 3A illustrates a right-side, and front perspective view of handguard assembly system 100; FIGS. 3B and 3C illustrate a cross-sectional view through handguard connector 140 as viewed looking into barrel 105; and FIG. 3D illustrates a right-side and front perspective view of handguard assembly system 100 shown partially exploded and with the handguard 110 partially installed over the barrel 150 and op rod 125.

FIG. 3A shows the handguard 110 installed on the upper receiver 150 with the handguard 110 fastened to an interfacing connector 170 (not visible) that is a separate component received in the handguard connector 140 between the barrel nut connector 108 and the rail 179. In one embodiment, the interfacing connector 170 installs over op rod 125 (or gas tube) and abuts the top portion of the barrel nut connector 108.

As shown in in the cross-sectional view of FIG. 3B, interfacing connector 170 installs over op rod 125 and has a curved bottom surface shaped to engage the circular outer surface of the barrel nut connector 108. Op rod 125 extends below interfacing connector 170 through channel 128. In one embodiment, channel 128 in the bottom surface of the interfacing connector 170 is sufficiently large to avoid direct contact between the interfacing connector 170 and op rod 125. When fasteners 180 are installed through handguard connector 140 and are tightened into interfacing connector 170, handguard connector 140 is drawn tightly against barrel nut connector 108 to secure the handguard 110 in position. In FIG. 3B, fasteners 180 extend horizontally into interfacing connector 170; in FIG. 3C, fasteners 180 extend upwardly into interfacing connector 170.

Referring to FIG. 3D, in some embodiments, the interfacing connector 170 defines protrusions 174 that extend from a bottom surface 129 to occupy a circumferential groove 109 between the barrel nut 107 and barrel nut connector 107. For example, in one embodiment, the interfacing connector 170 includes protrusions 174 that extend from a bottom surface 129 and fit into a circumferential groove 109 defined between the barrel nut connector 108 and the barrel nut 107. In other embodiments, the circumferential groove 109 is defined in an outside surface of the barrel nut 107 or barrel nut connector 108. In some embodiments, the protrusions 174 extend into groove 109 and directly engage the barrel nut 107. In other embodiments, the protrusions 174 merely overlap the distal end of the barrel nut connector 108. In the various embodiments, protrusions 174 occupy the circumferential groove 109 to maintain the axial position of handguard 110 in contact with or closely adjacent the distal end 151 of the upper receiver 150.

When the handguard 110 is installed on the upper receiver 150, the interfacing connector 170 is received in and attaches to the handguard connector 140, thereby securing the handguard 110 to the upper receiver 150 by clamping the handguard 110 to barrel nut connector 108 and interfacing connector 170. For example, the handguard 110 slides over the interfacing connector 170, barrel nut connector 108, barrel nut 107, barrel 105, and op rod 125. With apertures 145 of the handguard connector 140 aligned with apertures 175 of the interfacing connector 170, fasteners 180 are then inserted through the handguard connector 140 and threaded into the interfacing connector 170. Accordingly, the handguard 110 is securely installed on the upper receiver 150 in a free-floating fashion without direct contact with the barrel 105 or gas block 115.

Figure 4A:
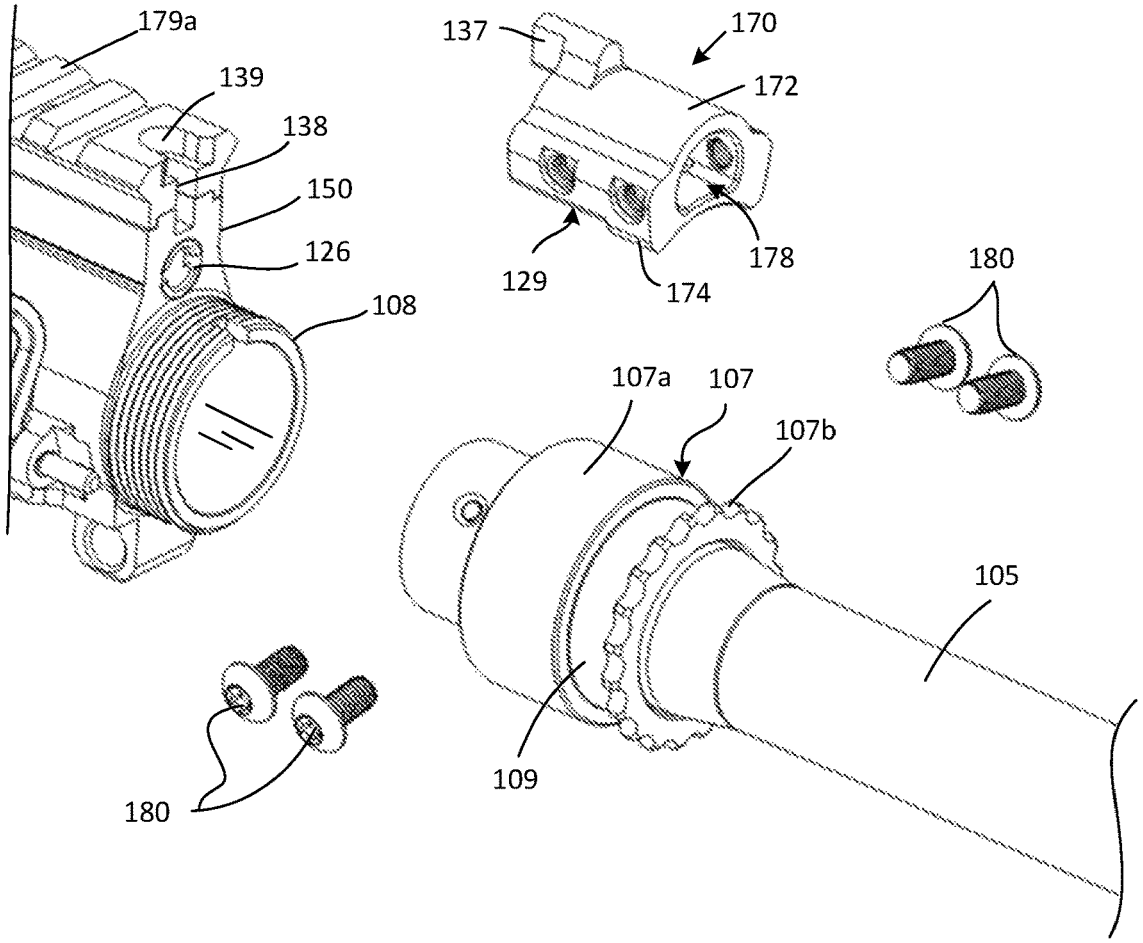
FIG. 4A illustrates an exploded right-side, top, and front perspective view showing an upper receiver, interfacing connector, and barrel of a handguard attachment system, in accordance with an embodiment of the present disclosure.

Referring to FIGS. 4A-4F, handguard assembly system 100 is illustrated in accordance with another embodiment of the present disclosure. FIG. 4A illustrates an exploded front and right-side perspective view showing a portion of barrel 105, interfacing connector 170, and part of upper receiver 150, in accordance with an embodiment of the present disclosure. The upper receiver 150 includes a barrel nut connector 108 extending distally with external threads. A proximal rail portion 179*a* extends along a top of the upper receiver 150 and defines an alignment opening 138 that extends into the top of the upper receiver 150 through the rail 179. In one embodiment, the alignment opening 138 is a generally rectangular slot extending down into the receiver 150 above the op rod opening 126 at the receiver distal end 150*a*. In some embodiments, alignment opening 138 can be positioned in other locations on upper receiver 150 and can include two or more slots, as will be appreciated.

The barrel 105 (or barrel assembly) can be secured to the upper receiver 150 using a barrel nut 107 with female threads (not visible) configured to engage the male threads on the barrel nut connector 108. In one embodiment, barrel nut 107 defines circumferential groove 109 between a barrel nut body 107*a* and a barrel nut ring 107*b*. Interfacing connector 170 includes a connector body 172 with protrusion 174 and alignment lug 137. Protrusion 174 has an arced shape and extends downward from bottom surface 129 to occupy the circumferential groove 109 on barrel nut 107. When handguard assembly system 100 is installed, bottom surface 129 of connector body 172 engages the cylindrical outer surface of barrel nut body 107*a*, for example. In some embodiments, bottom surface 129 and protrusion(s) 174 have an arcuate surface consistent with the rounded outer surface of barrel nut 107 and circumferential groove 109, respectively. In one embodiment, alignment lug 137 extends rearwardly from a top surface of connector body 172 so that alignment lug 137 can occupy alignment opening 138 above the op rod opening 126 when interfacing connector 170 is seated against barrel nut 107.

Figure 4B:
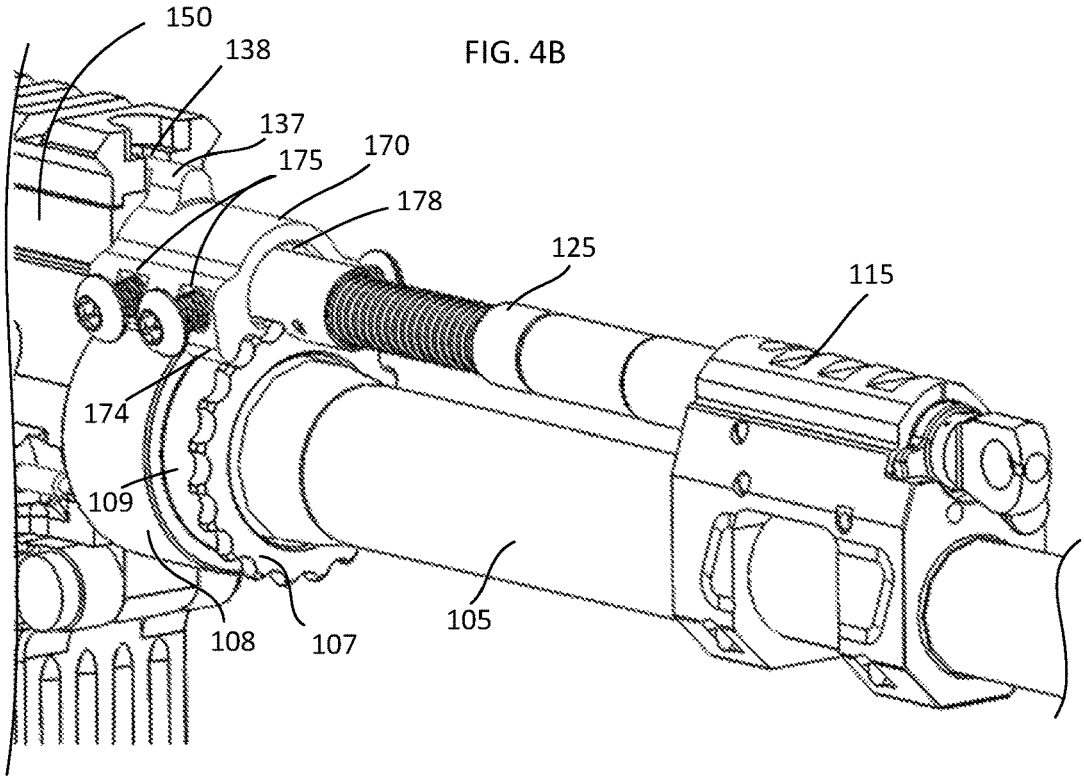
FIG. 4B illustrates a right-side and front perspective view showing the handguard attachment system of FIG. 4A with the barrel attached to the upper receiver and an op rod extending through the interfacing connector, in accordance with an embodiment of the present disclosure.

FIG. 4B illustrates a front and right-side perspective view of hand guard assembly system 100 showing the barrel 105 assembly attached to the upper receiver 150 and interfacing connector 170 in contact with barrel nut 107, in accordance with one embodiment. Barrel 105 is attached to upper receiver 150 by being partially received in the barrel nut connector 108 and secured with barrel nut 107 tightened to the barrel nut connector 108. Interfacing connector 170 is installed on a top surface of barrel nut 107 with alignment lug 137 received in the alignment opening 138 and op rod 125 extending axially through opening 178. Protrusions 174 from bottom surface 129 of interfacing connector 170 occupy circumferential groove 109. Fasteners 180 are installed in threaded apertures 175 in the interfacing connector 170 (handguard 110 is omitted for clarity).

Figure 4C:
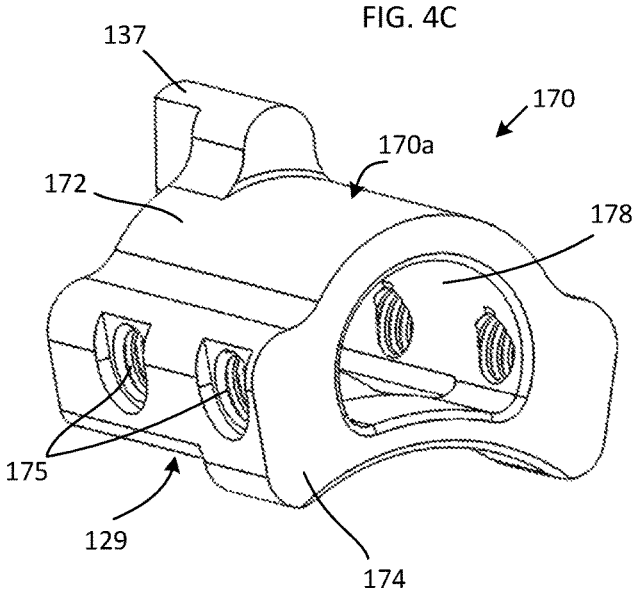
FIG. 4C illustrates a front, top, and right-side perspective view of an interfacing connector with alignment pin, in accordance with an embodiment of the present disclosure.
Figure 4D:
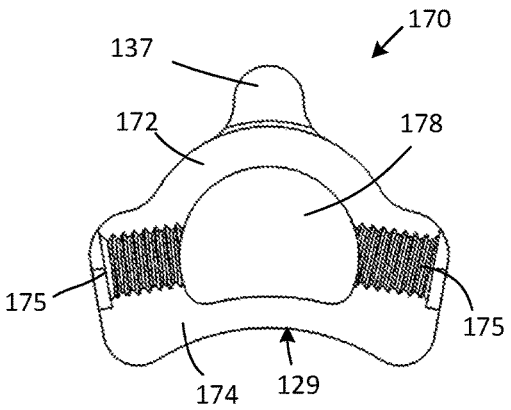
FIG. 4D illustrates a front cross-sectional view of the interfacing connector of FIG. 4A.
Figure 4E:
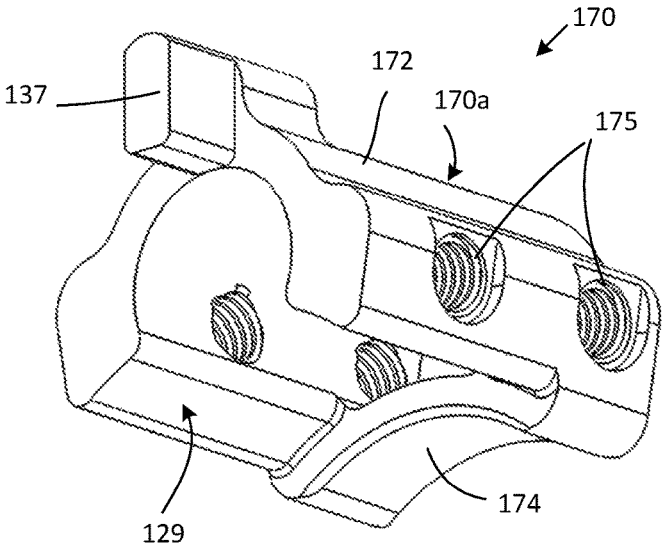
FIG. 4E illustrates a rear, bottom, and right-side of the interfacing connector of FIG. 4A.

FIGS. 4C, 4D and 4E illustrate a front and top perspective view, a front cross-sectional view, and a rear and bottom perspective view, respectively, of interfacing connector 170 in accordance with an embodiment of the present disclosure. As noted above, interfacing connector 170 has a connector body 172 with opening 178 extending axially therethrough. A distal portion 178*a* of opening 178 defines a channel that is open along bottom surface 129 in some embodiments while a proximal portion 178*b* defines a closed geometry sized to receive the op rod 125 therethrough. An advantage of a closed geometry is that interfacing connector 170 is less likely to be separated from the upper receiver 150 when handguard 110 is removed since interfacing connector 170 is retained by the op rod 125. In some embodiments, opening 178 is configured as a channel with an open bottom surface 129 along its entire length. Opening 178 is sized to permit free passage of op rod 125. Connector body 172 has a bottom surface 129 that is shaped to engage the outer surface of barrel nut connector 108 (or barrel nut 107). One or more protrusion 174 extends from bottom surface 129 and has an arcuate shape to occupy circumferential groove 109. In some embodiments, protrusion 174 can be a single protrusion as shown, or can be two or more protrusions. In any case, protrusion(s) 174 is (are) configured and sized to occupy circumferential groove 109 in barrel nut 107 (or barrel nut connector 108 as the case may be).

Alignment lug 137 extends proximally from connector body 172. In one embodiment as shown, alignment lug 137 is configured as a bar or rod that is connected to connector body 172 and extends partially along top surface 170*a* of connector body 172. For example, alignment lug 137 has a generally rectangular cross-sectional shape that is oriented vertically. Such shape with a greater height than width can provide additional torsional stability when received in alignment opening 138 since is resists lateral deflection as well as rotation about the alignment lug 137. In other embodiments, alignment lug 137 extends from connector body 172 and has a round, oval, or other cross-sectional shape that is received in a corresponding alignment opening 138. In some embodiments, alignment lug 137 includes a top portion that is shaped to occupy a corresponding enlarged alignment opening portion 139 (shown in FIG. 4A). For example, an upper portion of alignment lug 137 has a plate or disk extending horizontally to define a cross-sectional T-shape. Numerous variations and embodiments will be apparent in light of the present disclosure.

Figure 4F:
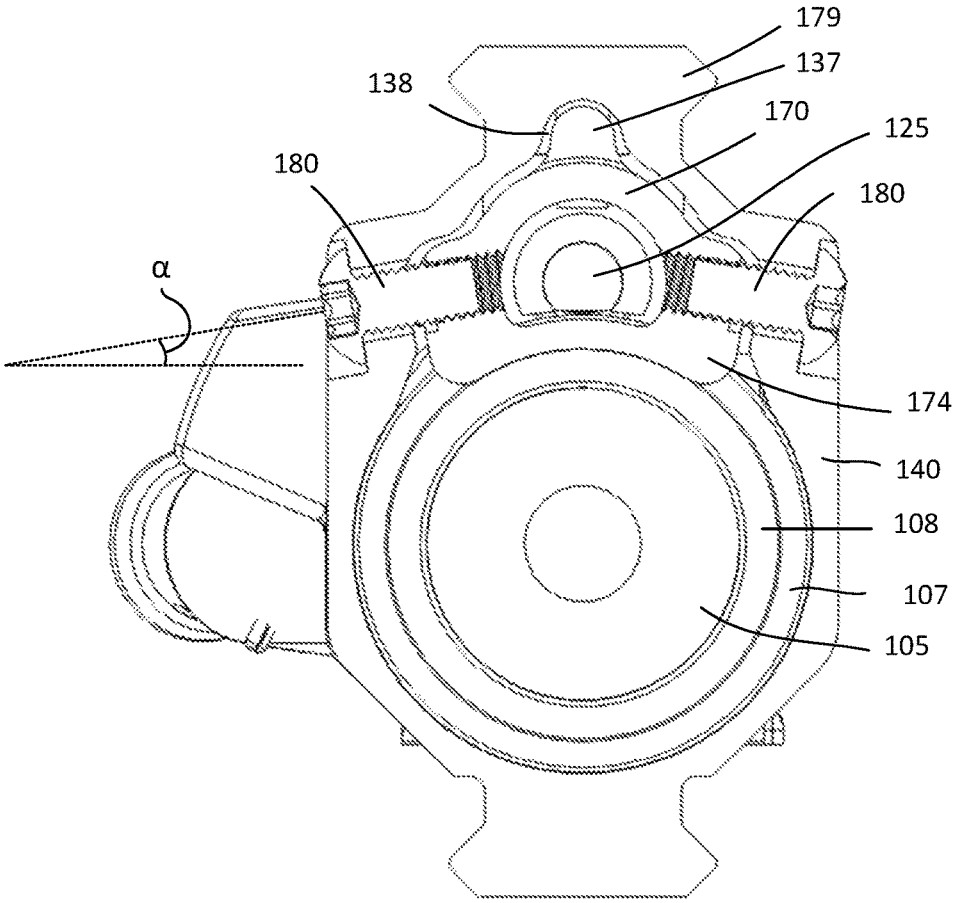
FIG. 4F illustrates a cross-sectional view taken through the handguard connector of a handguard attachment system showing the interfacing connector engaging a top surface of the barrel nut, in accordance with an embodiment of the present disclosure.
Figure 4G:
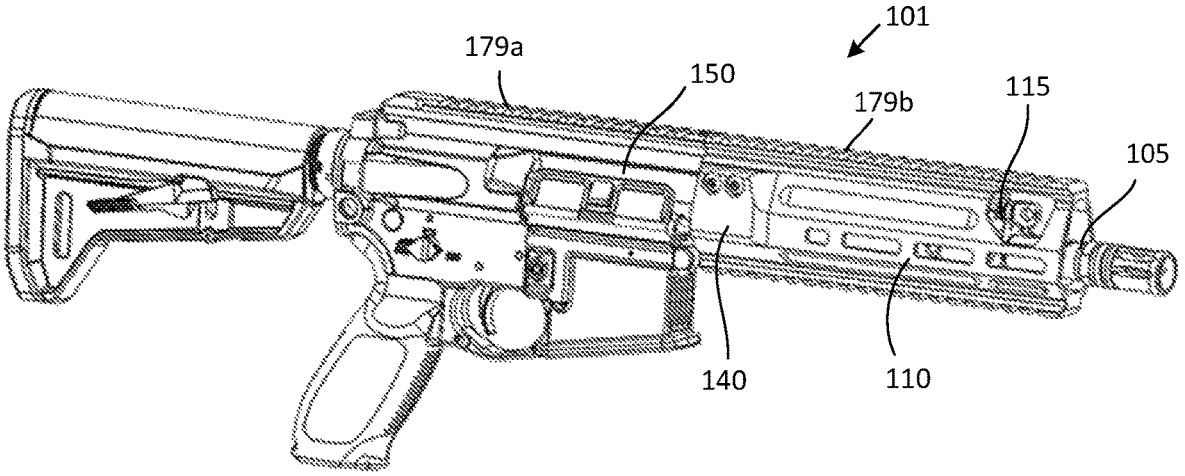
FIG. 4G illustrates a right-side and perspective view of a firearm with the handguard secured to the upper receiver, in accordance with an embodiment of the present disclosure.

FIG. 4F illustrates a cross-sectional view taken through a handguard connector 140 as viewed looking into the barrel 105, in accordance with one embodiment. Interfacing connector 170 is disposed between handguard connector 140 and barrel nut 107 with fasteners 180 extending at a slight upward angle $\alpha$ (e.g., 5-15° to the horizontal). Alignment lug 137 is received in the alignment opening 138. As fasteners 180 are tightened, handguard 110 and interfacing connector 170 are drawn against barrel nut 107 to secure handguard 110 to upper receiver 150. FIG. 4G illustrates a perspective view of a firearm 101 with a handguard 110 secured using the handguard assembly system 100, in accordance with an embodiment of the present disclosure. Proximal rail portion 179*a* and distal rail portion 179*b* are aligned along the top of the upper receiver 150 and handguard 110 with the handguard 110 extending along barrel 105 without contacting the barrel 105 or gas block 115.

Figure 5:
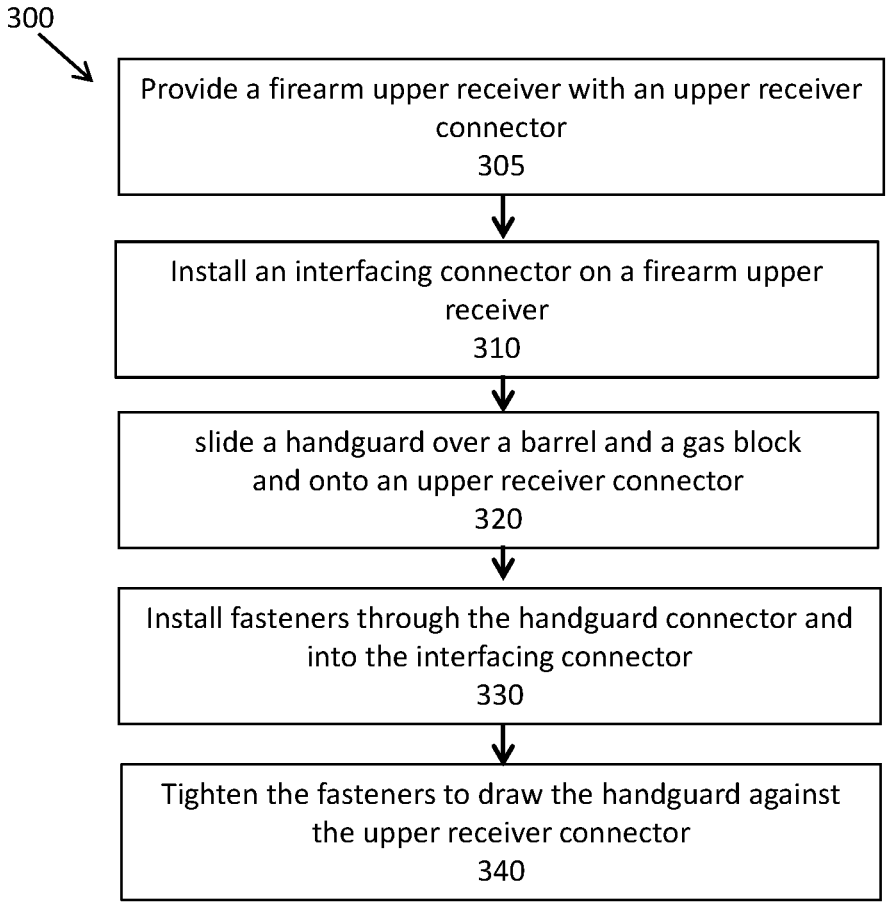
FIG. 5 illustrates a flowchart illustrating steps in a method of attaching a handguard to a firearm, in accordance with another embodiment of the present disclosure.

Referring now to FIG. 5, another aspect of the present disclosure is directed to a method 300 of attaching a handguard to a firearm. In one embodiment, method 300 includes providing 305 a rifle upper receiver with an upper receiver connector. For example, the upper receiver includes a barrel with gas block and op rod, where the barrel is secured to a barrel nut connector. Method 300 continues with installing 310 an interfacing connector in contact with or adjacent to an upper receiver connector on a firearm upper receiver. For example, the interfacing connector is installed 310 over the op rod or gas tube and placed in contact with the barrel nut and/or barrel nut connector. Method 300 continues with sliding 320 a handguard over the barrel and gas block and onto the upper receiver connector, such that apertures in the interfacing connector are aligned with apertures in the handguard connector of the handguard. Method 300 continues with installing 330 fasteners through the handguard connector and into the interfacing connector. Tightening 340 the fasteners draws the handguard against the upper receiver connector to secure the handguard to the firearm.

As will be appreciated in light of this disclosure, embodiments of the handguard assembly system 100 may include additional, fewer, and/or different elements or components from those here described, and the present disclosure is not intended to be limited to any particular configurations or arrangements of elements such as those variously described herein, but can be used with numerous configurations in numerous applications. Further, while in some embodiments, the handguard assembly system 100 can be configured as shown and described with respect to the various figures, the claimed invention is not so limited. Other suitable geometries, arrangements and configurations for various elements and components of the apparatus will depend on a given application and will be apparent in light of this disclosure.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

What is claimed is:

1. A handguard assembly for attachment to a firearm, the handguard assembly comprising:

an upper receiver with a barrel nut connector;

a barrel secured to the upper receiver by threaded engagement between a barrel nut and the barrel nut connector;

an interfacing connector in contact with a top surface of the barrel nut;

a handguard with an elongate perforated structure extending between a first end and a second end, the first end defining a handguard connector, wherein the handguard connector extends over the barrel nut connector, the barrel nut, and the interfacing connector when the handguard is installed on the upper receiver; and a plurality of fasteners configured to be installed between the handguard connector and the interfacing connector when the handguard is installed on the upper receiver;

wherein, when installed on a firearm, the handguard extends over the barrel without directly contacting the barrel.

2. The handguard assembly of claim 1, wherein the handguard connector engages the barrel nut connector when the handguard is installed on the firearm.

3. The handguard assembly of claim 1, wherein the handguard connector engages an outside surface of the barrel nut when the handguard is installed on the firearm.

4. The firearm handguard of claim 1 further comprising a gas block attached to the barrel and including a tube or rod extending from the gas block to the upper receiver, wherein the interfacing connector defines a channel configured to receive therethrough the tube or rod.

5. The firearm handguard of claim 1, wherein the interfacing connector defines at least one protrusion from a bottom surface, the at least one protrusion received in a circumferential slot defined at least in part by the barrel nut when the handguard is installed on the firearm.

6. The firearm handguard of claim 1, wherein the interfacing connector engages an upper portion of the barrel nut and the handguard connector engages a lower portion of the barrel nut when the handguard is installed on the firearm.

7. The firearm handguard of claim 1 further comprising a plurality of fasteners extending upward from the handguard connector and into the interfacing connector.

8. A method of attaching a handguard to a firearm, the method comprising:

providing a firearm upper receiver comprising an upper receiver connector that includes a barrel nut connector and a barrel nut, a barrel with a gas block, and a tube or rod extending from the gas block to the firearm upper receiver;

providing a handguard extending from a first end to a second end and defining a handguard connector on the first end;

placing an interfacing connector on a top of the barrel nut, the interfacing connector configured to attach to the handguard;

sliding the handguard over the barrel and the gas block with the handguard connector extending over the barrel nut connector, the barrel nut, and the interfacing connector, and with the handguard connector in alignment with the interfacing connector;

installing fasteners through the handguard connector and into the interfacing connector; and tightening the fasteners to draw the handguard connector against the barrel nut or barrel nut connector, thereby securing the handguard to the firearm such that the handguard extends over the barrel without directly contacting the barrel or the gas block.

9. The method of claim 8, wherein placing the interfacing connector on the top of the barrel nut includes placing the interfacing connector over the tube or rod.

10. The method of claim 9, wherein sliding the handguard over the barrel and the gas block includes the handguard connector sliding along an outside surface of the barrel nut.

* * * * *